US005095329A

United States Patent [19]

Morikawa

[11] Patent Number: 5,095,329

[45] Date of Patent: Mar. 10, 1992

[54] COPYING MACHINE

[75] Inventor: Takeshi Morikawa, Osaka, Japan

[73] Assignee: Minolta Camera Kabushiki Kaisha, Osaka, Japan

[21] Appl. No.: 258,185

[22] Filed: Oct. 14, 1988

[30] Foreign Application Priority Data

Oct. 16, 1987 [JP] Japan ..... 62-262499
Oct. 16, 1987 [JP] Japan ..... 62-262500

[51] Int. Cl.[5] ..... G03G 15/04

[52] U.S. Cl. ..... 355/69; 355/228; 355/229

[58] Field of Search ..... 355/69, 228, 229, 67, 355/203, 232, 208; 340/674

[56] References Cited

U.S. PATENT DOCUMENTS

| | | | |
|---|---|---|---|
| 4,463,284 | 7/1984 | Tamura et al. | 355/69 X |
| 4,827,313 | 5/1989 | Corona | 355/69 X |
| 4,845,526 | 7/1989 | Ito . | |
| 4,853,739 | 8/1989 | Miyamoto et al. | 355/229 |
| 4,855,648 | 8/1989 | Yagasaki | 355/208 X |
| 4,887,122 | 12/1989 | Morikawa | 355/69 X |

FOREIGN PATENT DOCUMENTS

| | | | |
|---|---|---|---|
| 578471 | 2/1982 | Japan . | |
| 61-102659 | 5/1986 | Japan . | |
| 61-275735 | 12/1986 | Japan . | |
| 0006239 | 1/1987 | Japan | 355/208 |
| 0006275 | 1/1987 | Japan | 355/208 |
| 0006276 | 1/1987 | Japan | 355/208 |
| 0234237 | 9/1988 | Japan | 355/67 |

OTHER PUBLICATIONS

IBM Technical Disclosure Bulletin, vol. 19, No. 2, Jul. 1976 "Lamp Control for Document Reproduction Machine" pp. 388-389.

*Primary Examiner*—Fred L. Braun
*Assistant Examiner*—Matthew S. Smith
*Attorney, Agent, or Firm*—Price, Gess & Ubell

[57] ABSTRACT

A copying machine having a fluorescent lamp as a light source for illuminating an original document. The machine has a print switch for commanding a copy start and a mechanism for expose-scanning the document being illuminated by the lamp in response to a command from the print switch. In this copying mechine, the lamp is maintained illuminating for a predetermined time period after completion of exposure-scanning by the exposure-scanning mechanism and the same is turned OFF if no copy start command is provided within the predetermined time period. Further, if the machine has a sensor for measuring the light amount, it becomes also possible to maintain the lamp illuminating for a predetermined time period after the light amount has reached a reference value subsequent to power input to the machine and to turn OFF the lamp if the predetermined time period passes without copy start command.

10 Claims, 6 Drawing Sheets

3
FLUORESCENT LAMP
36
SENSOR
39
38
LAMP CONTROL UNIT
37
30
MAIN CONTROL UNIT
31
MAIN SWITCH
32
PRINT KEY
33
LIGHT AMOUNT ADJUSTING KNOB
34
OPTICAL UNIT DRIVE UNIT
35
IMAGING UNIT DRIVE UNIT
OTHER INPUT DEVICES
OTHER OUTPUT DEVICES

COPYING MACHINE

BACKGROUND OF THE INVENTION

1) Field of the Invention

The present invention relates to a copying machine, and more particularly to a copying machine having a fluorescent lamp as its document exposure light source.

2) Description of the Prior Art

Conventionally, an output of a fluorescent lamp of the noted type is subject to variations depending on the temperature of its lamp tube wall. Accordingly, the fluorescent lamp has the disadvantage in that it is impossible to constantly obtain a sufficient amount of light from the lamp until its tube wall is properly warmed up.

A prior-art invention disclosed in a Japanese laid open patent No. 61-102659 has suggested a copying machine in which its fluorescent lamp is turned ON upon input of a copy start command and a copy run is initiated after an output of a light amount sensor for detecting a light amount of the lamp has reached a predetermined value.

With the above copier; however, there remains a problem as follows. That is, since the fluorescent lamp is turned ON only after the input of a copy start command, the lamp needs to be repeatedly turned ON and OFF if a plurality of copy operations are to be carried out in succession. This means that the copier is incapable of service while raising the lamp tube wall temperature which has been reduced during the OFF state of the lamp. Consequently, it will take a longer time period for completing all the copy operations.

Another prior-art invention disclosed in a Japanese laid-open patent No. 61-275735 has suggested a copying machine in which its fluorescent lamp is turned ON after being preheated for a predetermined time period subsequent to an ON operation of a power switch and a copy operation is permitted when a light amount of the lamp has reached a predetermined value. Further, with this copying machine, the fluorescent lamp is turned ON for testing its current output light amount not only immediately after the power-ON but also during disillumination or standby illumination condition of the lamp after an exposure operation.

With this copying machine, the fluorescent lamp is turned OFF or is repeatedly placed under the standby illumination condition after each exposure operation. Therefore, if the lamp is turned OFF, the copier will suffer from the same disadvantege of an extended copying time period as described hereinbefore. On the other hand, if the lamp is placed under the standby illumination condition, there will arise new problems of power and life waste of the lamp if the successive copy operations occur at long intervals.

SUMMARY OF THE INVENTION

The primary object of the present invention is to provide a copying machine improved over the aforementioned prior-art devices, the improved machine being capable of minimizing time and power loss in copying operations inherent in the prior-art.

For accomplishing the above-noted object, according to the present invention, a copying machine with a fluorescent lamp as its document exposure light source comprises: means for commanding a copy start; exposure scanning means for scanning an original document being exposed by illumination of the lamp in response to a command from the copy start command means; control means for maintaining the lamp illuminating for a predetermined time period after completion of the exposure by the exposure scanning means; and means for turning OFF the lamp in case of an absence of a next copy start command after the predetermined time period.

With the above construction, the fluorescent lamp is kept illuminated for the predetermined time period after completion of exposure. Thus, if a plurality of copy operations are carried out in succession by intervals each within the predetermined time period, since there occurs no cooling of the lamp, the next copy operation is possible without any time loss.

Further, according to one preferred embodiment of the present invention, the copying machine further comprises: means for measuring a light amount of the fluorescent lamp; and the machine is so controlled that the lamp is kept illuminating for a predetermined time period after a light amount of the lamp having been turned ON upon a power input to the machine has reached a predetermined value and then the lamp is turned OFF after lapse of the predetermined time period if no subsequent copy start command is input during the same.

With this copying machine having the above features, the fluorescent lamp is kept illuminated for the predetermined time period after completion of its preheating process has been accomplished subsequent to the power-ON. Consequently, even if a next copy operation is commanded shortly after completion of the preheating process, the lamp remains heated, whereby the preheating process need not be repeated and the time loss may be avoided in this case also.

Moreover, in comparison with the prior-art machines having a heater for controlling the lamp temperature, the copying machine of the present invention has the advantage of reduced number of a elements since its lamp is self-heated.

Further, this copying machine makes the most of the well-known advantage of use a of fluorescent lamp as its exposure light source. That is, compared with a halogen lamp, the fluorescent lamp is characterized by its lower heat generation. Because of this, it becomes possible to avoid excessive temperature rise in the vicinity of a document table thereby achieving a more simple mechanism in this vicinity while reducing total power consumption of the machine as well.

The foregoing and other objects, features and advantages of the invention will be apparent from the following more particular description of a preferred embodiment of the invention, as illustrated in the accompanying drawings.

DESCRIPTION OF A PREFERRED EMBODIMENT

A preferred embodiment of the invention will be particularly described hereinafter with reference to the accompanying drawings.

Figure 1:
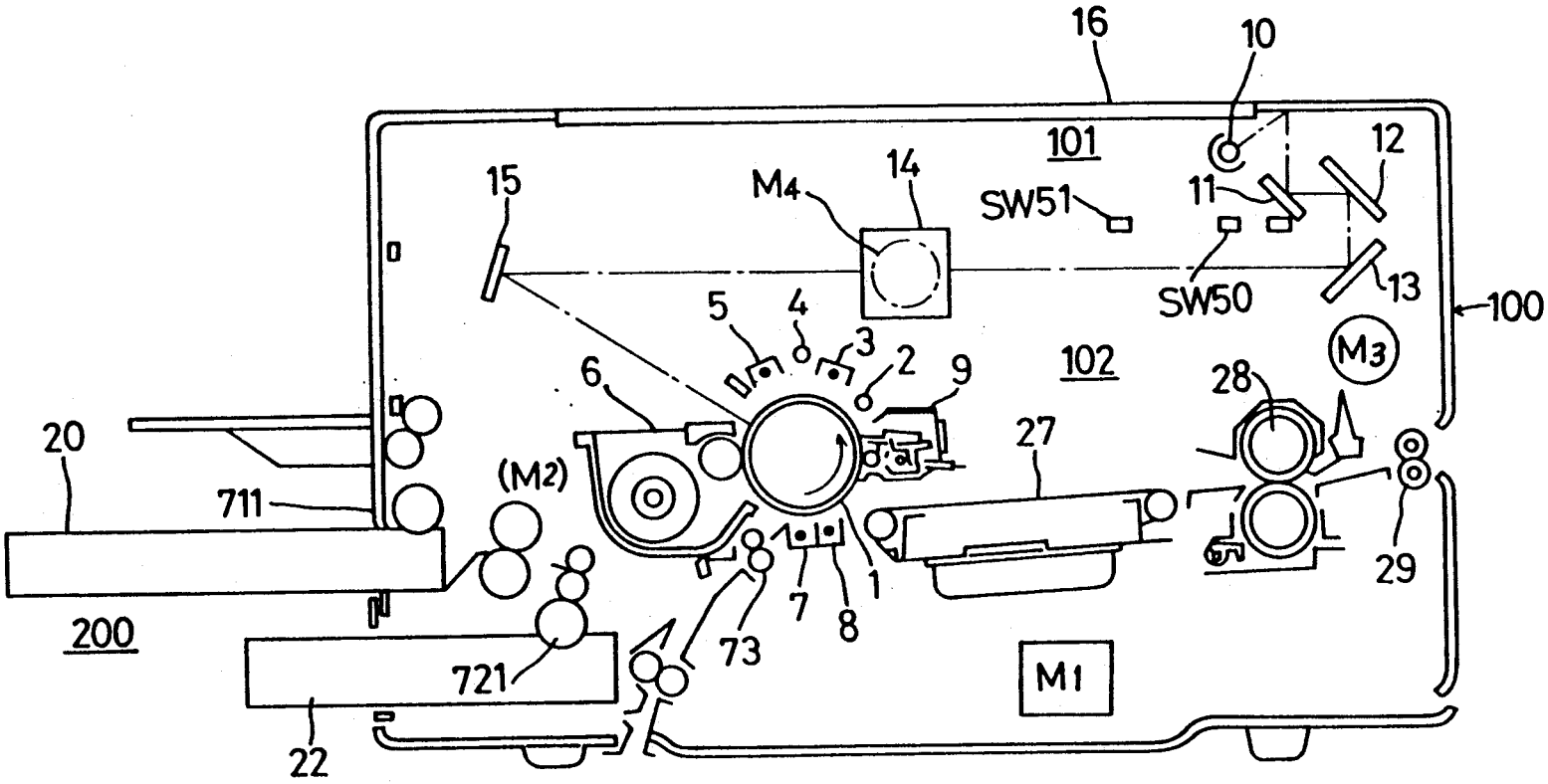
FIG. 1 is a schematic section showing a construction of a copying machine related to the present invention.

FIG. 1 is a schematic section showing a construction of a copying machine with a fluorescent document exposure lamp according to the embodiment of the present invention.

As shown, the copying machine includes an optical unit 101 disposed at an upper section inside a machine body 100, an imaging unit 102 disposed at a lower section inside the body 100 and a sheet feed cassette unit 200 disposed as being shown at the left side of the body 100.

(i) Optical unit

The optical unit 101 is operable to scan through exposure an original document set on a document glass table 16 and subsequently to form a copy image of the document on a photoreceptor drum 1 of the imaging unit 102 from a reflection light from the document face.

This optical unit 101 includes a fluorescent exposure lamp 10, reflecting mirrors 11, 12, 13 and 15 and a lens 14. In operation, the fluorescent exposure lamp 10 and the reflecting mirror 11 are both driven by a motor M3 at a speed of V/N; where V is a peripheral speed of the photoreceptor drum 1 and N is a copy magnification. Also, the reflecting mirrors 12 and 13 are driven by the motor M3 at a speed of V/2N. These driven components reciprocate along a lower face of the document table 16 to scan/expose the document.

The copy magnification is set by adjusting positions of a lens 14 and a reflecting mirror 15. An adjustment of an imaging position is effected through angle adjustment of the reflecting mirror 15. Incidentally, these components are driven by a further motor M4. Also, positions of the above movable optical unit components are detected by sensors SW50 and SW51.

(ii) Imaging unit

The imaging unit 102 is operable to effect the so-called electrophotographic imaging process, where an electrostatic latent image formed on the photoreceptor drum 1 is developed into a toner image, which is transferred and affixed to a copy sheet to be exhausted from the copying machine.

This imaging unit 102 includes the photoreceptor drum 1 supported to be rotatable counterclockwise, eraser lamps 2 and 4 disposed in the periphery of the drum 1, corona chargers 3 and 4, a developing device 6 driven by the motor M2, a transfer charger 7, a separator charger 8, a cleaning device 9, a conveyor belt 27 for conveying a toner-image bearing copy sheet, a fusing device for affixing the toner image to the copy sheet and a roller pair 29 for exhausting the image-affixed copy sheet from the imaging unit 102.

Incidentally, numeral 73 denotes a timing roller pair for feeding a copy sheet between the photoreceptor drum 1 and the transfer charger 7 at a predetermined timing synchronized with rotation of the drum 1. Mark M1 denotes a main motor.

(iii) Sheet feed cassette unit

The sheet feed cassette unit 200 includes an upper sheet feed tray 20 and a lower sheet feed tray 22, each tray accommodating copy sheets of a different size. A copy sheet in each tray is withdrawn by a sheet feed roller 711 or 721 to the timing roller pair 73 of the imaging unit 102 to be temporarily held thereat. Then, in response to a predetermined timing signal provided from the imaging unit 101, the sheet is fed between the photoreceptor drum 1 and the transfer charger 7 in synchronism with the rotation of the photoreceptor drum 1 to undergo the above-described imaging process thereat.

CONTROL CIRCUITRY

Figure 2:
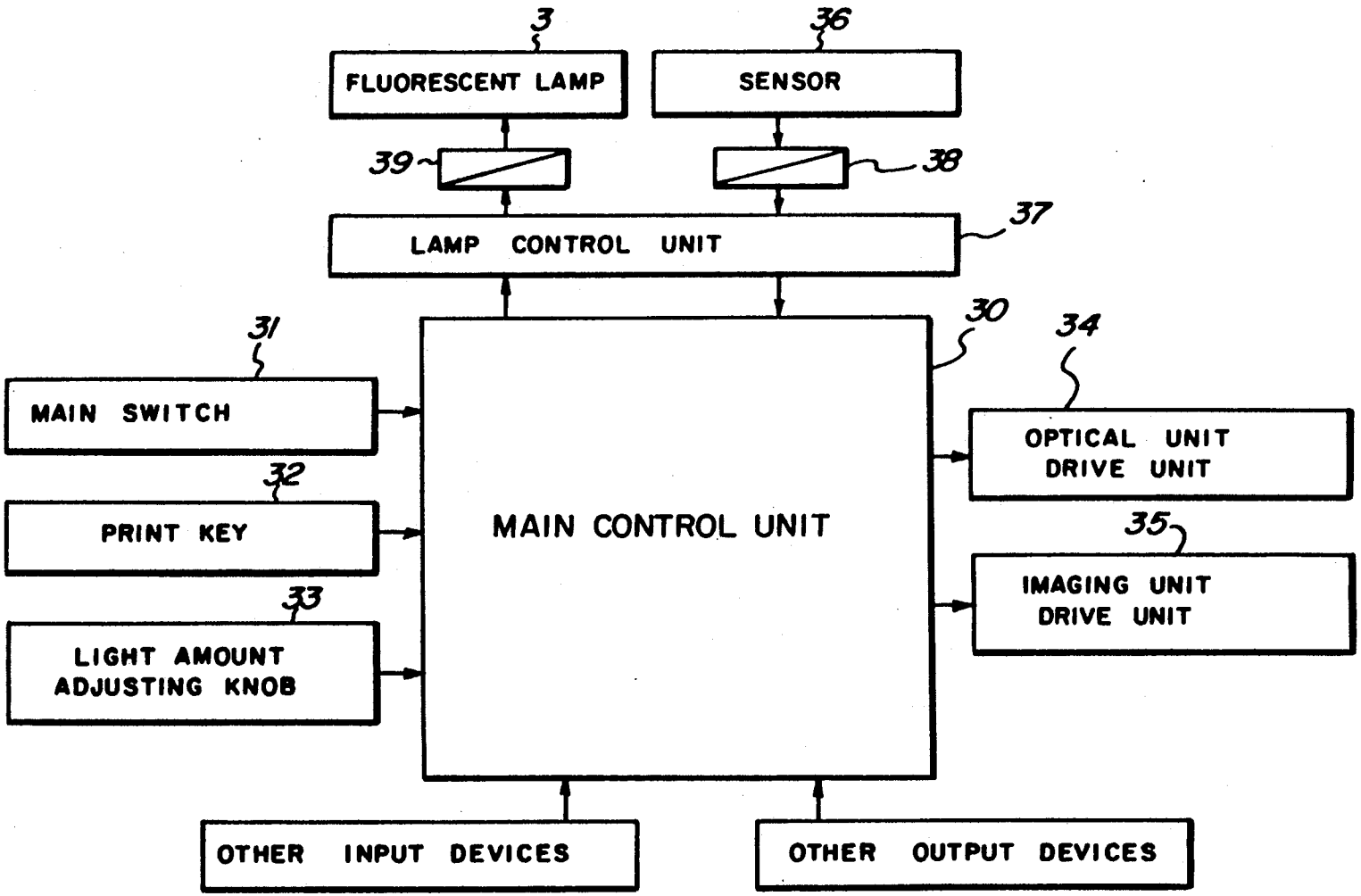
FIG. 2 is a block diagram of a control circuitry of the copying machine.
Figure 3:
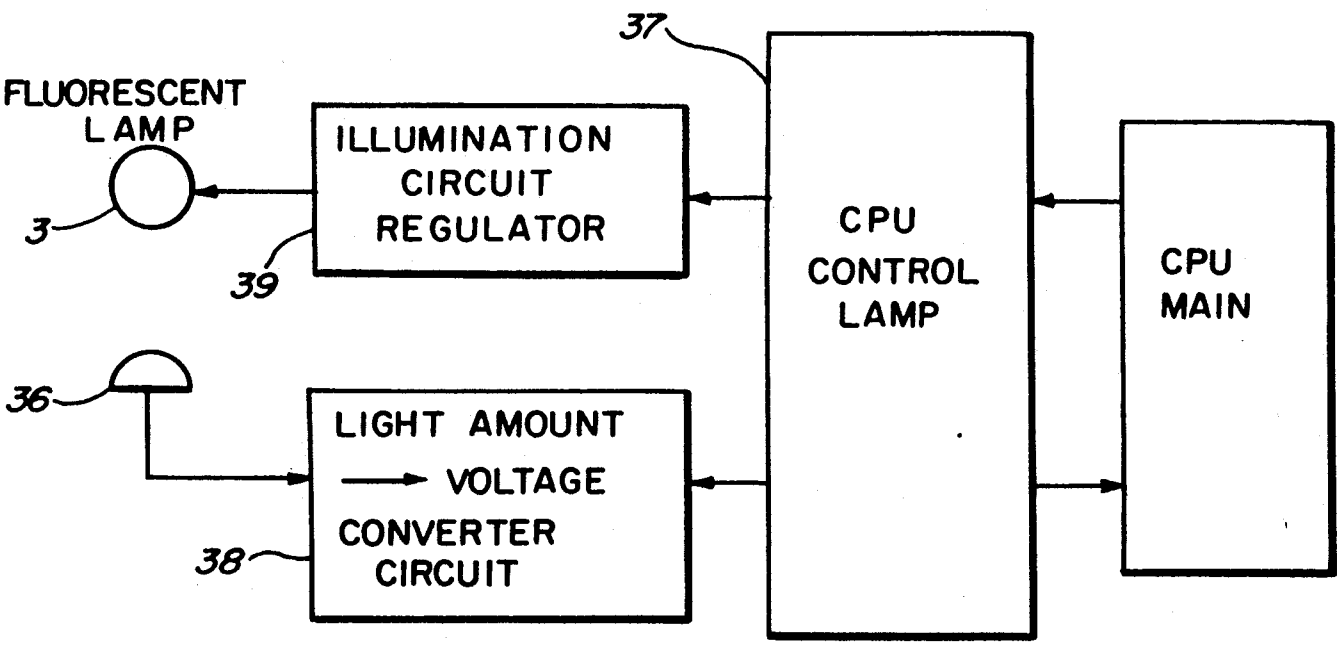
FIG. 3 is a block diagram of a control circuit of the machine according to one preferred embodiment of the invention.

FIGS. 2 and 3 are block diagrams of circuitry for controlling operations of the copying machine and illumination of the fluorescent lamp.

This control circuitry includes as major components thereof a main control unit 30 for controlling operations of the imaging unit 102, optical unit 101, sheet feed mechanism or the like and a lamp control unit for controlling illumination of the fluorescent lamp 3.

The main control unit receives signals, e.g. from various control switches such as a main switch 31, a print key switch 32 and an exposure light control knob 33, various sensors disposed at positions in the copier for sensing operational conditions or the like and from an unillustrated CPU (central processing unit).

On the other hand, the main control unit outputs signals, e.g. for controlling the drives of various components disposed in the periphery of the photoreceptor drum 1, signals for controlling a drive unit 34 of the optical unit (except for the lamp), signals for controlling operations of e.g. various clutches of the sheet feed system and other control signals for various display elements.

Also, this main control unit, which is substantially constituted by a CPU as apparent from FIG. 3, is connected via a bus with the lamp control unit 37 to communicate data therebetween.

On the other hand, the lamp control unit receives via a photoelectric transfer circuit 38 a signal from a sensor 36 disposed adjacent the fluorescent exposure lamp 3 for sensing a light amount of this lamp 3.

The lamp control unit outputs via an illumination circuit regulator 39 a high-frequency control signal for driving the fluorescent exposure lamp 3. Incidentally, adjustment of the light amount of the lamp 3 is effected by adjusting a duty ratio of the high-frequency control signal to consequently vary an applied voltage to the lamp 3.

OPERATION

Figure 4A:
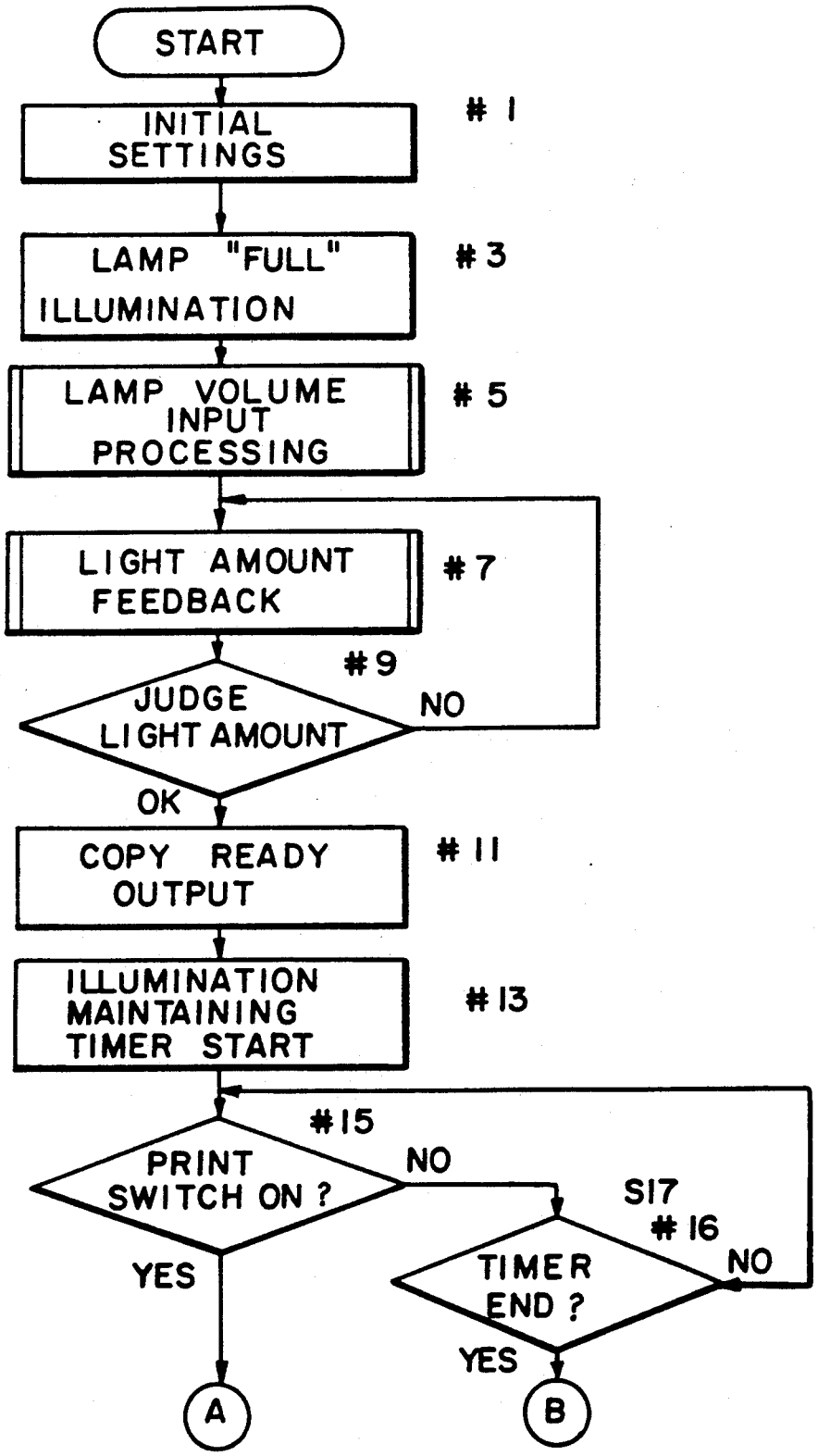
FIGS. 4*a*, 4*b* and 4*c* are a flow chart illuminating processes executed by a central processing unit of the embodiment machine.
Figure 4B:
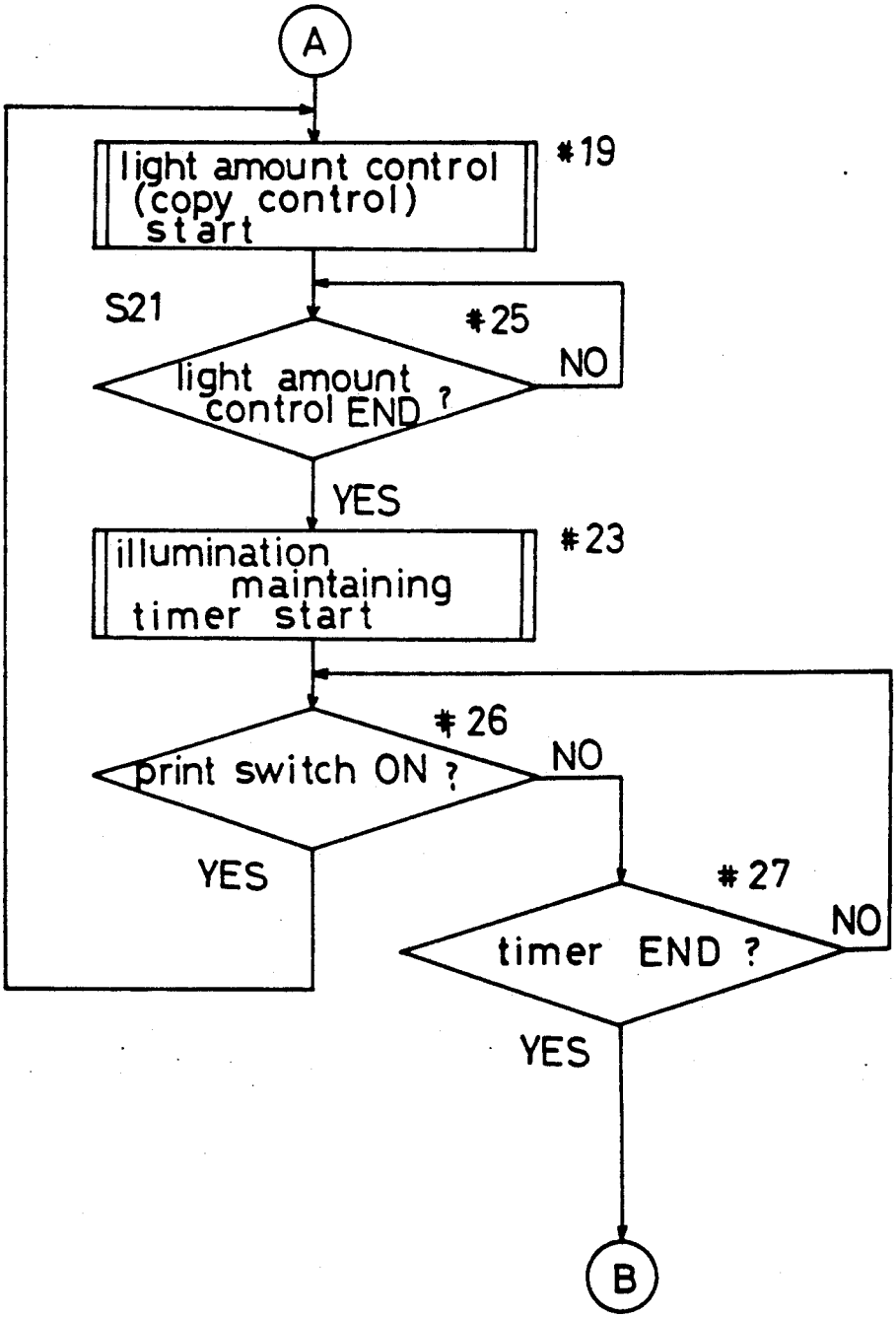
Figure 4C:
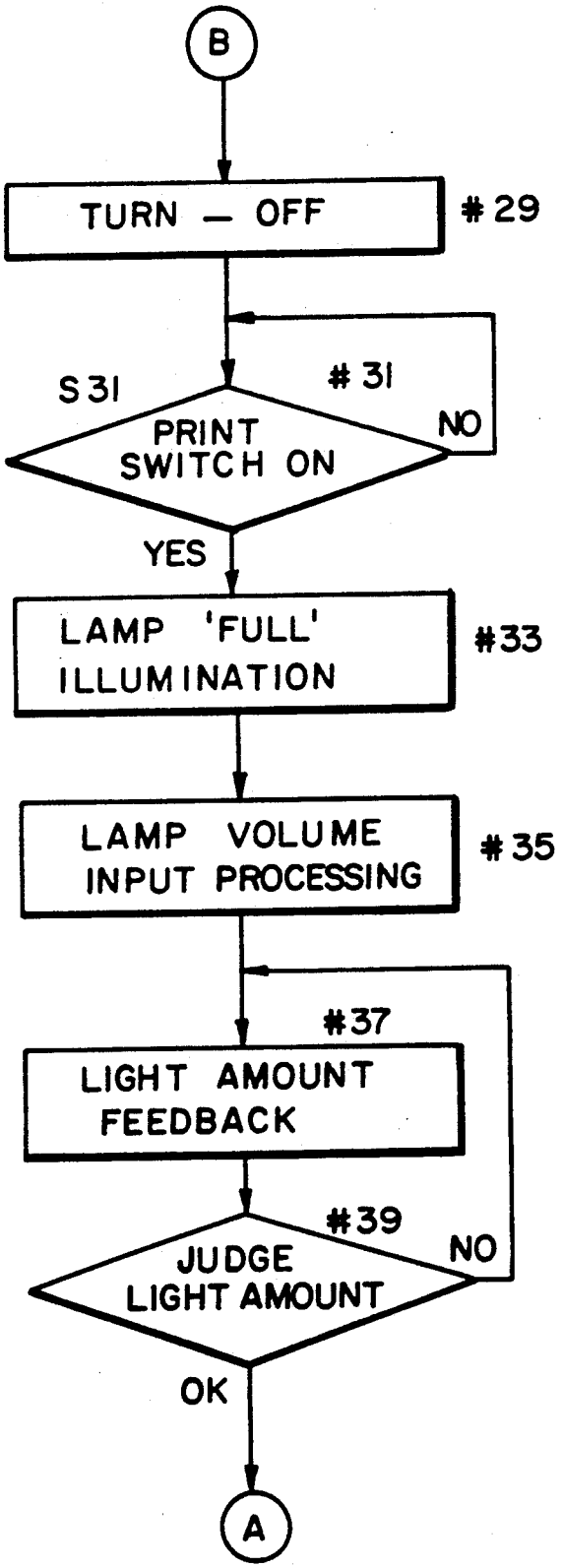

FIGS. 4*a*, 4*b* and 4*c* are a flow chart illustrating processes executed by the fluorescent lamp control CPU. Incidentally, the processes executed by the main control CPU are the same as the prior art and therefore will not be described here.

With, e.g. a power input to the copying machine, the lamp control CPU initiates its control scheme and effects initial settings at step #1. Then, at step #3, the CPU generates to the lamp 3 a signal requesting its 'full' illumination. More particularly, the CPU sets 100% to the duty ratio of the high-frequency control signal for driving the lamp 3 thereby applying the maximum driving power to the same. With this, a preheating process of the fluorescent lamp 3 is started. Incidentally, adjustment of this lamp driving power (will be more particularly described later) is effected through adjustment of the duty ratio of the high-frequency control signal.

At step #5, the CPU executes an operation for processing input from the exposure adjustment knob switch. This operation is for setting a sensitivity level (a reference voltage value) of the sensor 30 in accordance with the input exposure knob switch value transmitted from the main control unit. This reference voltage value set at step #5 is utilized for a judging process at step #9 to be described later.

At steps #7 and #11, the object light amount value, i.e. the above reference voltage value, set by the exposure adjusting knob is compared with an actual light amount value of the fluorescent lamp 3 and the process waits for the actual value to reach the object value. More specifically, the actual light amount value is sensed and photoelectrically transferred by the sensor 30. Then, the process waits for the resulting voltage value to equate with the reference voltage vlaue. In other words, the process waits until a sufficient amount of light becomes obtainable after completion of the preheating process.

With the above waiting process, if it is judged at step #9 that the actual light amount has reached the object value, a copy ready signal is transmitted to the main control unit at step #11. With the input of this copy ready signal, the main control unit is released from its copy unready status due to an improper amount of exposure light amount.

At step #13, the CPU sets a timer for regulating an illumination duration time period after the light amount from the lamp 3 has reached the reference value. As long as this timer is in operation, even if it is judged at step #15 that no print switch input is present for commanding a start of copy operation, the fluorescent lamp 3 is maintained at its illuminating condition as it is judged at step #17 that the timer has not timed up yet. As a result, even if a print switch input is not provided immediately after the copier becomes ready for service with the rise of light amount to the predetermined value (see steps #3 through #11), the lamp 3 keeps illuminating; thus, the copier remains ready for its next service as long as the next print switch input is provided within the predetermined duration of the timer. Incidentally, the timer is set to a duration of approximately 10 seconds.

On the other hand, if it is judged at step #15 that a print switch input has been provided within the timer duration, a light amount control operation is carried out at steps #19 and #21. The purpose of this light amount control operation is for maintaining the actual light amount of the fluorescent lamp 3 at the object value set by the exposure adjusting knob throughout the execution of the copy run. More particularly, in this light amount control operation, the duty ratio of the high-frequency driving signal is adjusted in real time so as to decrease a difference between the actual light amount value detected by the sensor 30 and the object light amount value while comparing these to each other. On the other hand, the other ordinary copy control operations for, e.g. the scanning unit and other components about the photoreceptor drum 1 are executed by the main control unit.

After completion of the above light amount control operation, at step #22, the process again sets the timer for regulating the illumination duration time period; then, as in the same manner as the above steps #13 though #17, even if it is judged at step #25 that no print switch input is present, the fluorescent lamp 3 is maintained at its illuminating condition as long as it is judged at step #27 that the timer has not timed up yet. With this control scheme, even if the next print switch input is provided immediately after completion of one copy run (see step #21), the copying machine immediately becomes ready for the next copy run upon input of the next print switch as long as the input is provided within the timer duration.

On the other hand, if it is judged at step #17 or #27 that the timer has already timed up, i.e. no next print key input has been provided within the timer duration, the lamp control CPU executes processes after step #29.

That is, after the lamp 3 is turned OFF at step #29, the process waits at step #31 for a next print switch input.

Also, if presence of next print key input is determined at step #31, the same operations as those at steps #3 through #9 are executed at steps #33 through #39 for raising the actual light amount value to the reference light amount value. Then, the process goes on to step #19 to carry out the aforementioned light amount control operation.

What is claimed is:

1. A copying machine with a fluorescent lamp as its document exposure light source comprising:
   - means for commanding a copy start;
   - exposure scanning means for scanning an original document being exposed by illumination of the lamp in response to a command from said copy start command means;
   - control means for maintaining the illumination of the lamp for a specific preset predetermined time period after completion of the exposure by said exposure scanning means; and
   - means for turning OFF the lamp when a subsequent copy start command does not occur within said predetermined time period.

2. A copying machine as claimed in claim 1, wherein said exposure scanning means includes a sensor for measuring a light amount from the lamp and adjusting means for adjusting the light amount from the lamp to a predetermined value during an exposure scanning of the document in accordance with an output from said sensor.

3. A copying machine with a fluorescent lamp as its document exposure light source comprising:
   - means for measuring a light amount of the lamp;
   - initial control means for turning ON the lamp in response to a power input to the copying machine and maintaining the illumination of the lamp until the light amount of the lamp reaches a predetermined value;
   - control means for maintaining the illumination of the lamp for a predetermined time period after the light amount of the lamp turned ON by said initial control means has reached the predetermined value;
   - means for commanding a copy start; and
   - means for turning OFF the lamp after lapse of the predetermined time period in case no copy start command is input within the time period.

4. A copying machine as claimed in claim 3, further comprising:
   - means for expose-scanning the document while maintaining the light amount of the light source at the predetermined value based on a command from said copy start commanding means, said means including adjusting means for adjusting the light amount of the lamp constant in accordance with an output of said light amount measuring means.

5. A copying machine with a fluorescent lamp as its document exposure light source, comprising:
   - means for commanding a copy start;

exposure scanning means for scanning an original document being exposed by illumination of the lamp in response to a command from said copy start command means;

first control means for maintaining the illumination of the lamp for a first predetermined time period after completion of the exposure by said exposure scanning means;

second control means for turning ON the lamp in response to a power input to the copying machine and maintaining the illumination of the lamp until a light amount of the lamp reaches a predetermined value, the second control means maintaining the illumination of the lamp for a second predetermined time period after the light amount of the lamp has reached the predetermined value; and means for turning OFF the lamp after lapse of the first and second predetermined time periods in case no copy start command is input within the respective predetermined time periods.

6. In a copying machine having a fluorescent lamp as its document exposure light source, the light output of the fluorescent lamp being a function of a wall temperature of the fluorescent lamp, the improvement comprising;

means for commanding a power start mode of operation;

means for sensing the light output of the florescent lamp;

means for driving the fluorescent lamp at a maximum load cycle during a power start mode of operation;

means for comparing the sensed light output of the sensing means with a predetermined value and providing a copy ready output, when the sensed light output matches or exceeds the predetermined value;

means for exposing an original document with the light output, and, means for maintaining the fluorescent lamp at or above the predetermined value of the comparing means for a predetermined time period after an exposure operation to maintain the wall temperature of the fluorescent lamp at an operative temperature for a subsequent exposure operation.

7. A method of controlling a copying machine which has a fluorescent lamp as its document exposure light source, the method comprising the steps of:

issuing a copy start command;

turning ON the fluorescent lamp in response to the copy start signal for executing a document exposure operation;

sensing the light output of the fluorescent lamp;

comparing the sensed light output with a predetermined value;

maintaining the light output of the fluorescent lamp at the predetermined value;

exposing an original document with the light output of the predetermined value, and turning OFF the fluorescent lamp when a next copy start command is not issued within a predetermined time period after the exposure step.

8. A method of controlling a copying machine which has a fluorescent lamp as its document exposure light source, the method comprising the steps of:

driving the fluorescent lamp at a maximum load cycle in response to a power input to the copying machine;

sensing the light output of the fluorescent lamp;

judging whether the light output of the fluorescent lamp reaches a predetermined value, and turning OFF the fluorescent lamp when a copy start command is not issued within a predetermined time period after the light output of the fluorescent lamp has reached the predetermined value.

9. A copying machine which has a fluorescent lamp as its document exposure light source, comprising:

command means for issuing a copy start command;

exposure means responsive to said command means for exposing an original document with the light output of the fluorescent lamp, and means for turning OFF the fluorescent lamp when another copy start command is not issued within a predetermined time period after the operation of said exposure means.

10. A copying machine which has a fluorescent lamp as its document exposure light source, comprising:

means for driving the fluorescent lamp at a maximum load cycle in response to a power input to the copying machine;

means for sensing the light output of the fluorescent lamp and judging whether the light output reaches a predetermined value;

command means for issuing a copy start command, and means for turning OFF the fluorescent lamp when a copy start command is not issued within a predetermined time period after the light output of the fluorescent lamp has reached the predetermined value.

* * * * *